US006379201B1

(12) United States Patent
Biggs et al.

(10) Patent No.: US 6,379,201 B1
(45) Date of Patent: Apr. 30, 2002

(54) MARINE ENGINE COOLING SYSTEM WITH A CHECK VALVE TO FACILITATE DRAINING

(75) Inventors: Timothy M. Biggs; Matthew W. Jaeger; Andrew K. Logan; Christopher J. Luckett, all of Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/716,533

(22) Filed: Nov. 20, 2000

(51) Int. Cl.[7] ..... B63H 21/10

(52) U.S. Cl. ..... 440/88; 123/44; 137/100

(58) Field of Search ..... 440/88; 123/41.14, 123/41.44; 137/100

(56) References Cited

U.S. PATENT DOCUMENTS

| | | | | |
|---|---|---|---|---|
| 3,550,612 A | * | 12/1970 | Maxon | 123/41.44 |
| 5,334,063 A | | 8/1994 | Inoue et al. | 440/88 |
| 5,980,342 A | | 11/1999 | Logan et al. | 440/88 |
| 6,004,175 A | | 12/1999 | McCoy | 440/88 |
| 6,135,064 A | | 10/2000 | Logan et al. | 123/41.14 |

* cited by examiner

*Primary Examiner*—Jesus D. Sotelo
(74) *Attorney, Agent, or Firm*—William D. Lanyi

(57) ABSTRACT

A marine engine cooling system is provided with a valve in which a ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

20 Claims, 6 Drawing Sheets

MARINE ENGINE COOLING SYSTEM WITH A CHECK VALVE TO FACILITATE DRAINING

BACKGROUND OF THE INVENTION

1. Field of the Invention

The present invention is generally related to marine engine cooling systems and, more specifically, to a marine engine cooling system that facilitates draining the cooling system when the engine is not operating and provides appropriate engine cooling flow paths during the engine's operation.

2. Description of the Prior Art

Marine engine cooling systems typically utilize a pump, sometimes referred to as a seawater pump, to draw water from a body of water in which a marine vessel is operating. The water, drawn from a lake or ocean, is then used to lower the temperature of the engine and its associated components. After flowing through passages of the cooling system, the cooling water is returned to the body of water from it was drawn.

It is advisable to periodically drain the cooling water from the engine and its associated cooling passages. This is particularly beneficial if the potential exists for the cooling system to be subjected to freezing temperatures. As is well known to those skilled in the art, frozen liquid in the cooling passages of an engine and associated components can cause severe damage. Therefore, it is necessary to assure that all entrained liquid within the cooling system is drained when the marine engine is not in use and particularly if the cooling system is subjected to freezing temperatures.

U.S. Pat. No. 5,980,342, which issued to Logan et al on Nov. 9, 1999, discloses a flushing system for a marine propulsion engine. The flushing system provides a pair of check valves that are used in combination with each other. One of the check valves is attached to a hose located between the circulating pump and the thermostat housing of the engine. The other check valve is attached to a hose through which fresh water is provided. Both check valves prevent flow of water through them unless they are associated together in locking attachment. The check valve attached to the circulating pump hose of the engine directs a stream of water from the hose toward the circulating pump so that water can then flow through the circulating pump, the engine pump, the heads, the intake manifold, and the exhaust system of the engine to remove seawater residue from the internal passages and surfaces of the engine. It is not required that the engine be operated during the flushing operation.

U.S. Pat. No. 5,334,063, which issued to Inoue et al on Aug. 2, 1994, describes a cooling system for a marine propulsion engine. A number of embodiments of cooling systems for marine propulsion units are disclosed which have water cooled internal combustion engines in which the cooling jacket of the engine is at least partially positioned below the level of the water in which the water craft is operating. The described embodiments all permit draining of the engine cooling jacket when it is not being run. In some embodiments, the drain valve also controls the communication of the coolant from the body of water in which the water is operating with the engine cooling jacket. Various types of pumping arrangements are disclosed for pumping the bilge and automatic valve operation is also disclosed.

U.S. Pat. No. 6,004,175, which issued to McCoy on Dec. 21, 1999, discloses a flush valve which uses only one moving component. A ball is used to seal either a first or second inlet when the other inlet is used to cause water to flow through the valve. The valve allows fresh water to be introduced into a second inlet in order to remove residual and debris from the cooling system of the marine propulsion engine. When fresh water is introduced into a second inlet, the ball seals the first inlet and causes the fresh water to flow through the engine cooling system. When in normal use, water flows through the first inlet and seals the second inlet by causing the ball to move against a ball seat at the second inlet. Optionally, a stationary sealing device can be provided within the second inlet and a bypass channel can be provided to allow water to flow past the ball when the ball is moved against the ball seat at the first inlet. This minimal flow of water is provided to allow lubrication for the seawater pump impeller if the seawater pump is operated during the flushing operation in contradiction to recommended procedure.

U.S. Pat. No. 6,135,064, which issued to Logan et al on Oct. 24, 2000, discloses an improved drain system. The engine cooling system is provided with a manifold that is located below the lowest point of the cooling system of the engine. The manifold is connected to the cooling system of the engine, a water pump, a circulation pump, the exhaust manifolds of the engine, and a drain conduit through which all of the water can be drained from the engine.

The patents described above are hereby expressly incorporated by reference in the description of the present invention.

It is desirable that marine engine cooling systems be constructed in a way that allows for efficient passage of cooling water through heat generating components of the marine propulsion system. This includes the proper sequence in which the water flows through the various heat producing components in order to maximize the efficiency of the cooling system. It is also desirable that the cooling system can be drained with minimal human interaction when the engine is not operating. In many instances, these two goals are conflicting. It would therefore be significantly beneficial if a cooling system for a marine engine could be provided in which efficient flow of coolant is made possible when the engine is operating, and in which the various cooling passages may be easily drained when the engine is not operating.

SUMMARY OF THE INVENTION

A marine engine cooling system made in accordance with the present invention comprises a valve which has first, second, and third ports. The valve also has a cavity within it which is in fluid communication with the first, second, and third ports. A ball is disposed within the cavity of the valve. The position of the ball within the cavity is a function of forces on the ball which result from gravity buoyancy or pressure differential and from the movement of fluid through the cavity.

The marine engine cooling system of the present invention also comprises a pump having an outlet connected in fluid communication with the first port of the valve. It further comprises a fluid conducting component connected in fluid communication between the pump and the third port. This fluid conducting component can be an engine heat exchanger or one or more cooling passages of the engine itself. The ball is movable within the cavity to at least partially block fluid flow from the first port to the second port when the fluid pressure at the first port is higher than the fluid pressure at the second port. This movement causes the ball to move up and into contact with a seat associated with the second port. Fluid communication between the second and third ports remains unaffected by movement of the ball within the cavity. A fluid path from the second port to the first port remains open when fluid pressure at the first port is not greater than fluid pressure at the second port.

The cooling system of the present invention can further comprise an exhaust manifold which has a water jacket disposed in fluid communication with the second port in order to receive cooling water from the second port. The fluid conducting component of the present invention can be a heat exchanger or a cooling passage of the marine engine. The valve can be attached to an exhaust manifold of the engine. The marine engine cooling system can be a closed system, wherein water pumped from a body of water by the pump flows in thermal communication with a coolant which passes through cooling passages of the marine engine. Alternatively, the marine engine cooling system can be an open system, wherein water pumped from a body of water by the pump flows through cooling passages of the marine engine in thermal communication with the engine.

A power steering fluid cooler or other coolers can be connected in fluid communication with the pump. The third port of the valve can be connected in fluid communication with a conduit that is located between the cavity of the valve and the second port. Flow of fluid between the second and third ports is unaffected by movement of the ball within the cavity of the valve.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
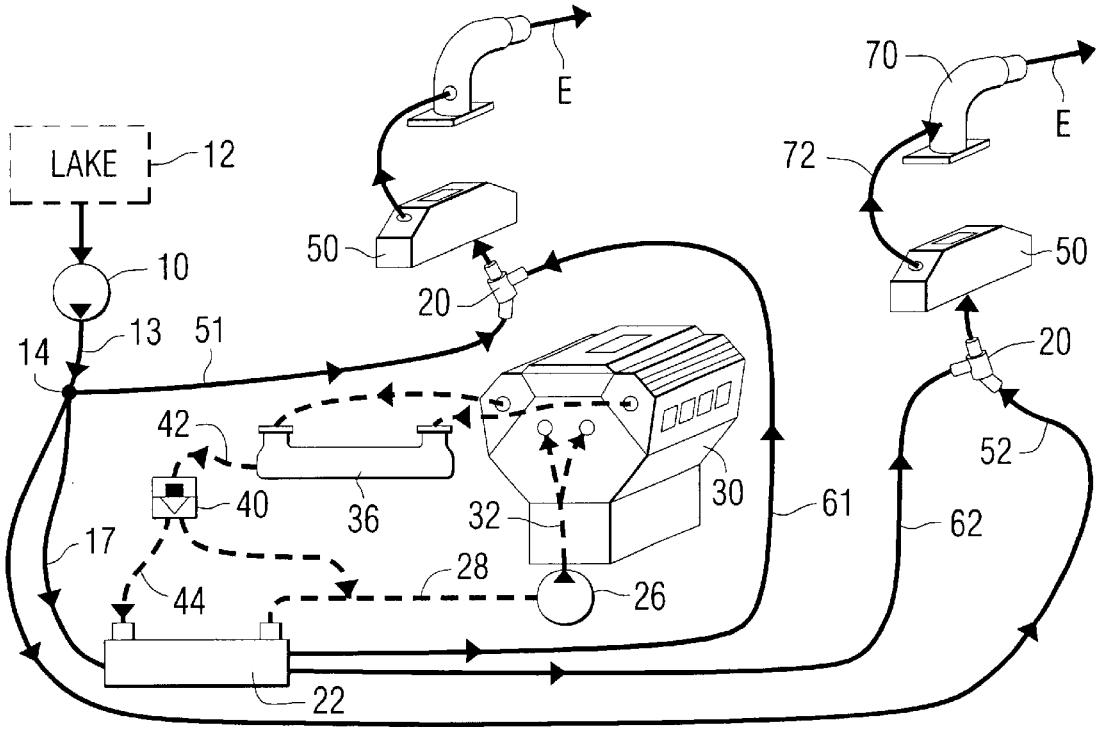
FIGS. 1 and 2 show two types of marine engine cooling systems.

Throughout the description of the preferred embodiment of the present invention, like components will be identified by like reference numerals.

Figure 2:
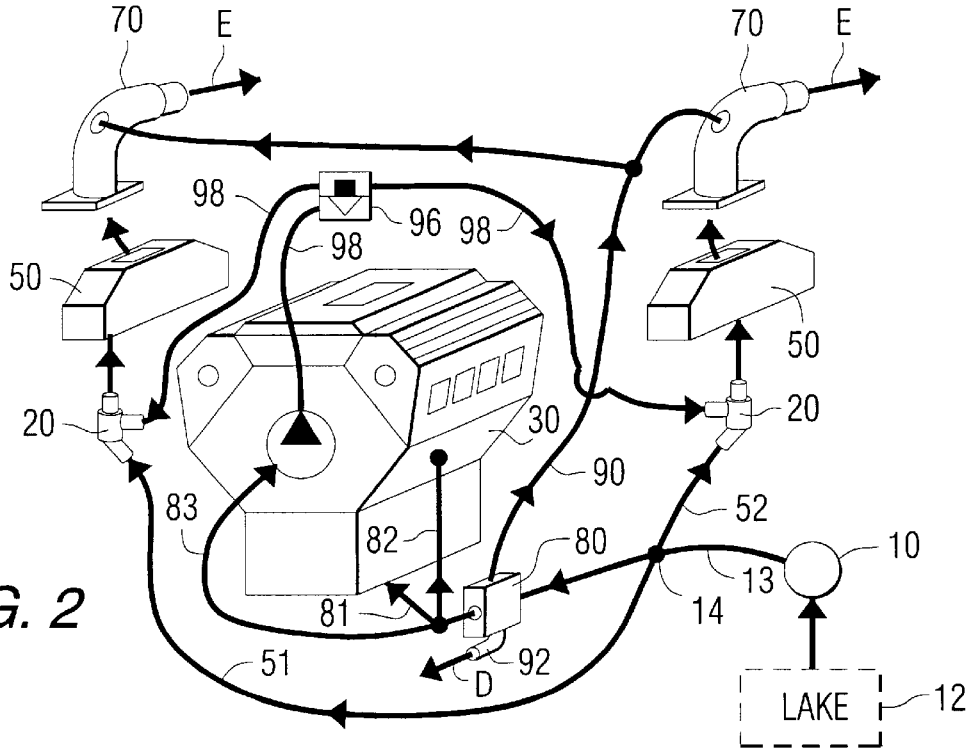

FIGS. 1 and 2 show two alternative types of marine engine cooling systems. FIG. 1 illustrates an exploded schematic representation of a partially closed cooling system for a marine engine. The engine cooling system is closed, but the exhaust manifolds are water cooled with cooling water drawn from the body of water in which the system is operated. A pump 10 draws water from a body of water represented by dashed box 12 in FIG. 1. The water is pumped to a junction point identified by reference numeral 14. The junction point 14 is connected directly to two valves 20 of the present invention and also to an engine heat exchanger 22. The cooling system shown in FIG. 1 is a closed cooling system in which a liquid coolant, such as glycol, is continuously recycled within a closed system. That flow of glycol through the closed cooling system is represented by dashed lines in FIG. 1. The liquid coolant is drawn from the engine heat exchanger 22 by a circulation pump 26, as represented by dashed line 28. The coolant is pumped into and through the engine block 30, as represented by dashed line 32. The coolant flows from the engine block 30 to a cross-over manifold 36 which combines the flows of liquid coolant and directs the coolant toward a thermostat 40, as represented by dashed line 42. The liquid coolant, such as glycol, is then directed back to the engine heat exchanger 22, as represented by dashed line 44. To remove the heat from the closed cooling system of liquid coolant, represented by dashed lines in FIG. 1, water from the lake or ocean 12 flows through the engine heat exchanger 22 and is directed toward the valves 20 of the present invention. In most applications, two valves 20 are used because two exhaust manifolds 50 are associated with the engine 30. It should be understood that, from junction 14, two fluid paths, 51 and 52 are provided between the pump 10 and the valves 20. It should also be understood that the flow of water through lines 51 and 52 is under the influence of virtually the full pressure provided by the pump 10. Throughout this description of the present invention, the term "seawater" shall mean any water drawn from the ocean or lake in which the marine propulsion system is operated, whether the water is saltwater or freshwater.

With continued reference to FIG. 1, it can be seen that two fluid lines, 61 and 62, flow from the engine heat exchanger 22 to the valves 20. From the valves 20, seawater can flow upward and into the water jackets of the exhaust manifolds 50. From the exhaust manifolds 50, the water continues its flow to the exhaust elbows 70, through line 72, and is combined with the exhaust gases flowing from the elbows 70, as represented by arrows E. It should be noted that the flow of water through line 51 to valve 20 is at a higher pressure than the flow of water through line 61 to valve 20. Similarly, the pressure in line 52 is greater than line 62. The reason for this differential magnitude of pressure is that water flowing through lines 61 and 62 pass through the engine heat exchanger 22 prior to flowing to the valves 20, whereas water through lines 51 and 52 pass directly from pump 10 to valves 20. The structure of the valves 20 will be described in greater detail below.

FIG. 2 illustrates an open cooling system of the type that is commonly used in marine propulsion systems. The cooling system shown in FIG. 2 is also provided with two valves 20 which accomplish functions that are similar to the valves 20 described above in conjunction with FIG. 1. The pump 10 draws water from a body of water 12 and provides that water to junction 14, from which it can flow directly through lines 51 and 52 to the valves 20 of the present invention. From junction 14, cooling water also flows to a coolant manifold housing 80 similar to that described in significant detail in U.S. Pat. No. 6,135,064. The water flowing to manifold housing 80 can follow several alternative paths. One path conducts the water directly to the engine block 30, by paths 81, 82, and 83. This water is caused to flow through cooling passages of the engine 30 to remove heat from the engine. Although not shown in FIG. 2, the water flows through the engine, the cylinder heads, and the exhaust manifolds before being returned to the body of water.

Water from the manifold housing 80 can also flow directly to the exhaust elbows 70, as represented by line 90. The manifold housing 80 also has a drain outlet 92 that allows seawater to be drained from the cooling system, as represented by arrow D in FIG. 2. When the operator of the marine vessel wishes to flush the cooling system, water is introduced into a flush port 96. Water can then flow, as represented by arrows 98, to the cooling passages of the engine 30 and to the valves 20 of the present invention. The flush water follows the same path as cooling water.

Figure 3:
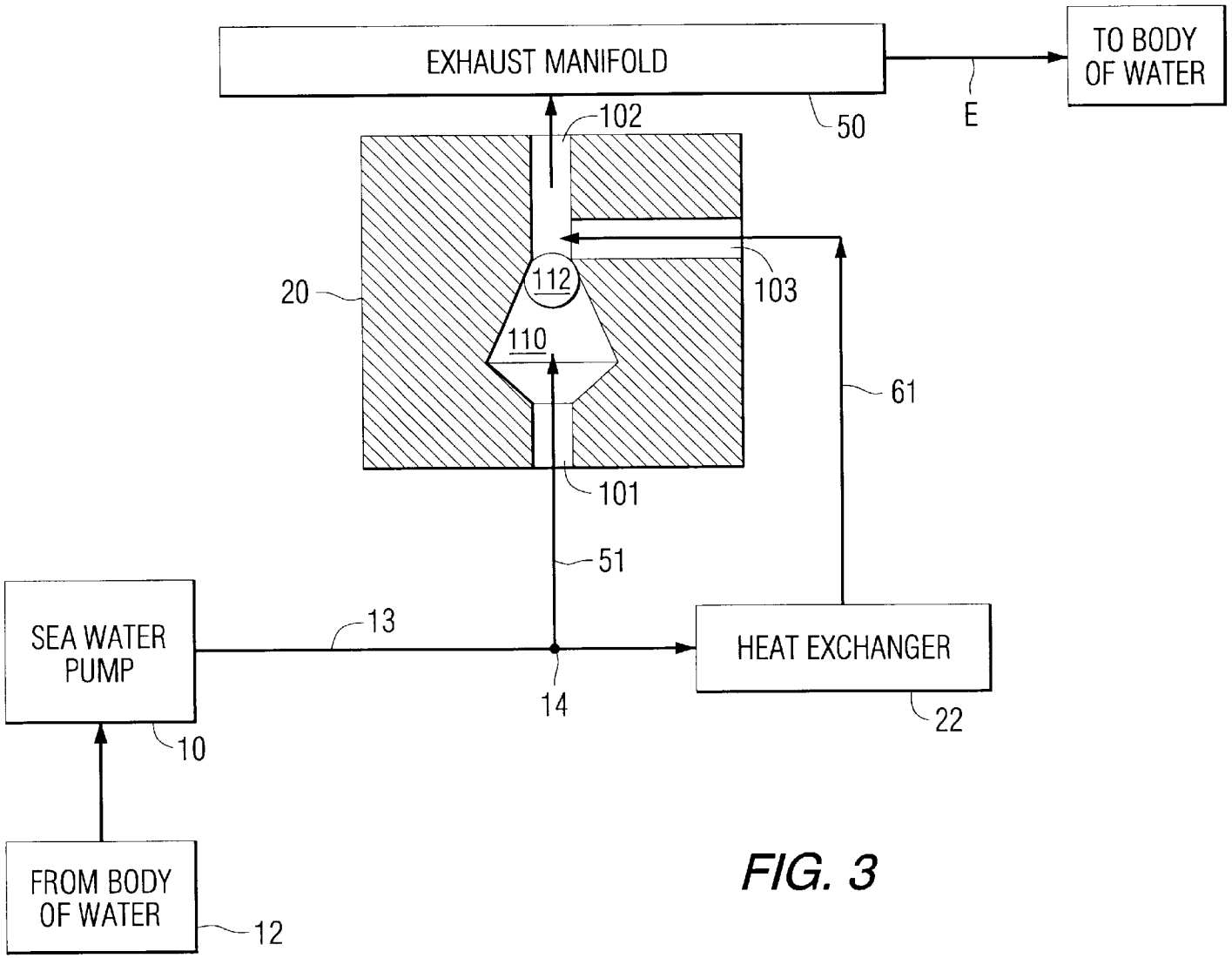
FIGS. 3 and 4 are simplified illustrations of the present invention in both operating and draining modes.
Figure 4:
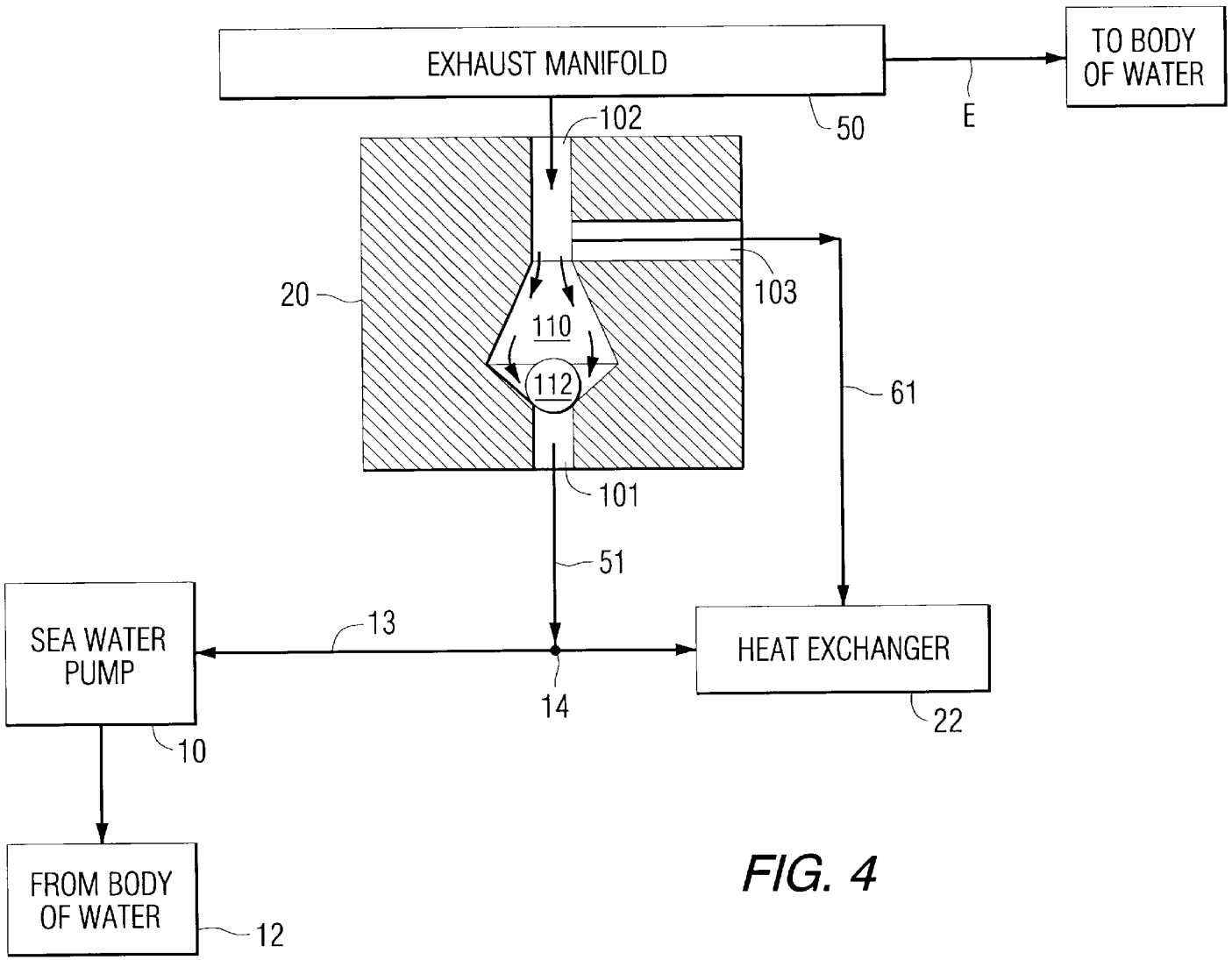

In order to more clearly understand the operation of the valve 20 of the present invention, FIGS. 3 and 4 present highly simplified schematic representations of the relevant portions of the cooling system, including the valve 20 which is shown in section view. With reference to FIGS. 1 and 3, the valve 20 has a first port 101, a second port 102, and a third port 103. The position of the ball 112 within the cavity 110 is a function of the force of gravity on the ball 112 and it is also a function of the movement of fluid through the cavity 110. The specific gravity of the material used to make the ball 112 can be greater than or less than the specific gravity of water flowing through the cavity 110.

Under normal operation, the fluid pressure at the first port 101 is greater than the fluid pressure at the second and third ports, 102 and 103, for the reasons discussed above. Therefore, the ball 112 is moved upward within cavity 110 and against a ball seat to block fluid flow from the first port 101 toward the second port 102. The pressure remains high at the first port 101, but little or no water flow passes through the cavity 110 because the ball 112 is seated against the ball seat and is blocking that passage. Water flowing through line 61, after passing through the heat exchanger 22, is at a lower pressure than the fluid pressure at the first port 101. Therefore, the pressure above the ball 12 is not sufficient to force it downward and away from its ball seat at the upper portion of cavity 110. In addition, lower downstream pressure between the second port 102 and the exhaust manifold 50 lowers the pressure above the ball 112. Any attempted flow upward from the first port 101 and through the cavity 110 will move the ball 12 against its ball seat to block this flow. The other components illustrated in FIG. 3 are described above in conjunction with FIG. 1.

FIG. 4 shows the components of FIGS. 1 and 3, but with the sea pump 10 not operating. When the pressure at the first port 101 is not greater than the pressure at the second and third ports, 102 and 103, the ball 112 is free to drop within the cavity 110 and unblock the ball seat at the upper portion of the cavity. As water drains from the various water cooled components, such as the exhaust manifold 50, the flow of water through the cavity 110 further urges the ball 112 toward a downward position. Although not clearly visible in FIG. 4, the lower portion of cavity 110 does not comprise a ball seat to allow the ball 112 to block the first port 101. Instead, the lower portion of cavity 110 is provided with ridges or other type of protrusions to prevent the ball 112 from blocking the first port 101.

As a result, water is free to drain through the cavity 110 and around the ball 112, as represented by the arrows in the cavity. With the ball in the lower portion of the cavity 110, as shown in FIG. 4, the manifolds 50 can easily drain and all of the water can be removed from the components associated with the second port 102.

Figure 5:
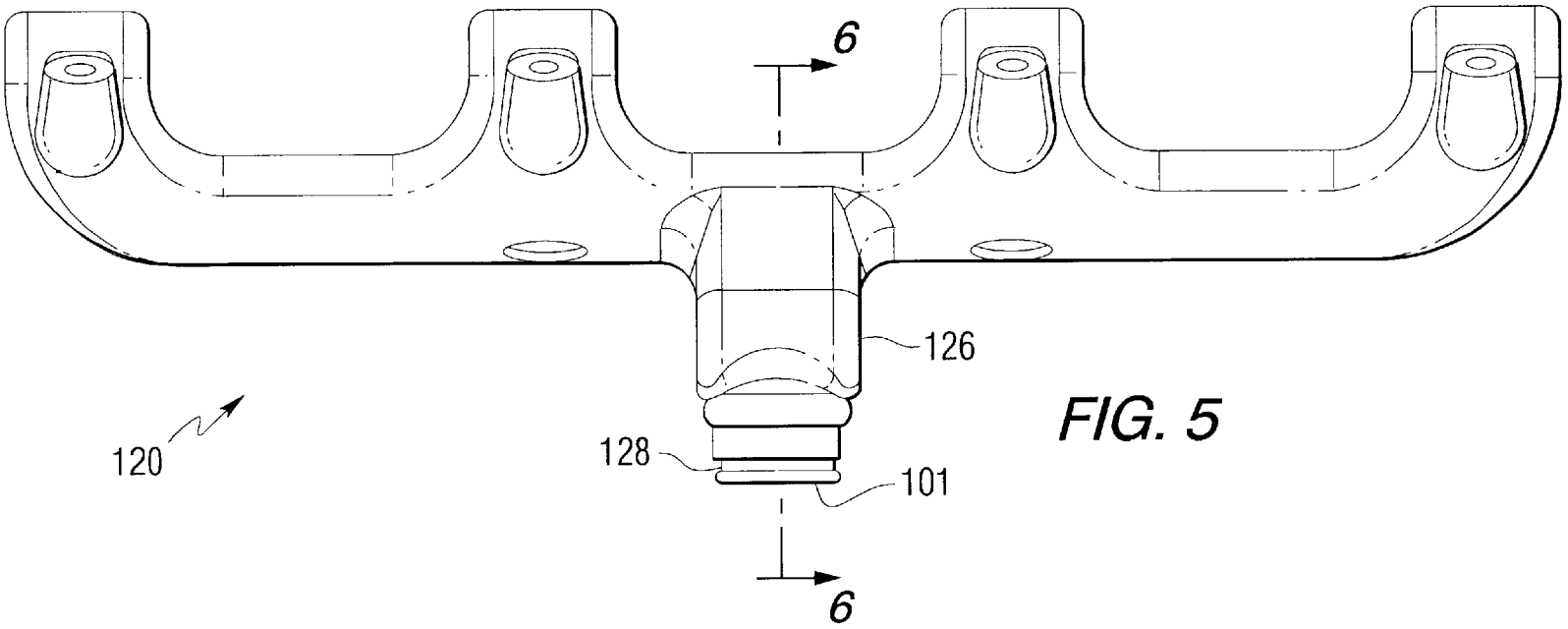
FIG. 5 is a water manifold used in some marine engine cooling systems.

FIG. 5 shows one type of water manifold 120 that can be used in conjunction with an exhaust manifold 50 of the type described above in conjunction with FIGS. 1 and 2. The purpose of the water manifold 120 is to direct a flow of water into a waterjacket of the exhaust manifold 50.

Figure 6:
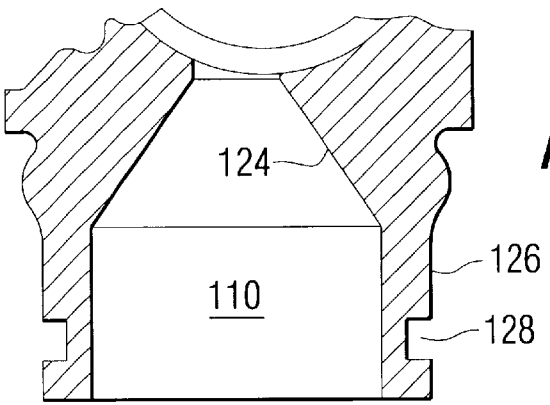
FIG. 6 is a section view of FIG. 5.

FIG. 6 is a section view of the water manifold 120 shown in FIG. 5. The cavity 110 is illustrated in FIG. 6, including the ball seat 124 which is a generally conical surface against which the ball can move to block flow upward through the cavity 110. It should be noted that a groove 128 is provided to facilitate this combination of components to form the completed valve assembly 20.

Figure 8:
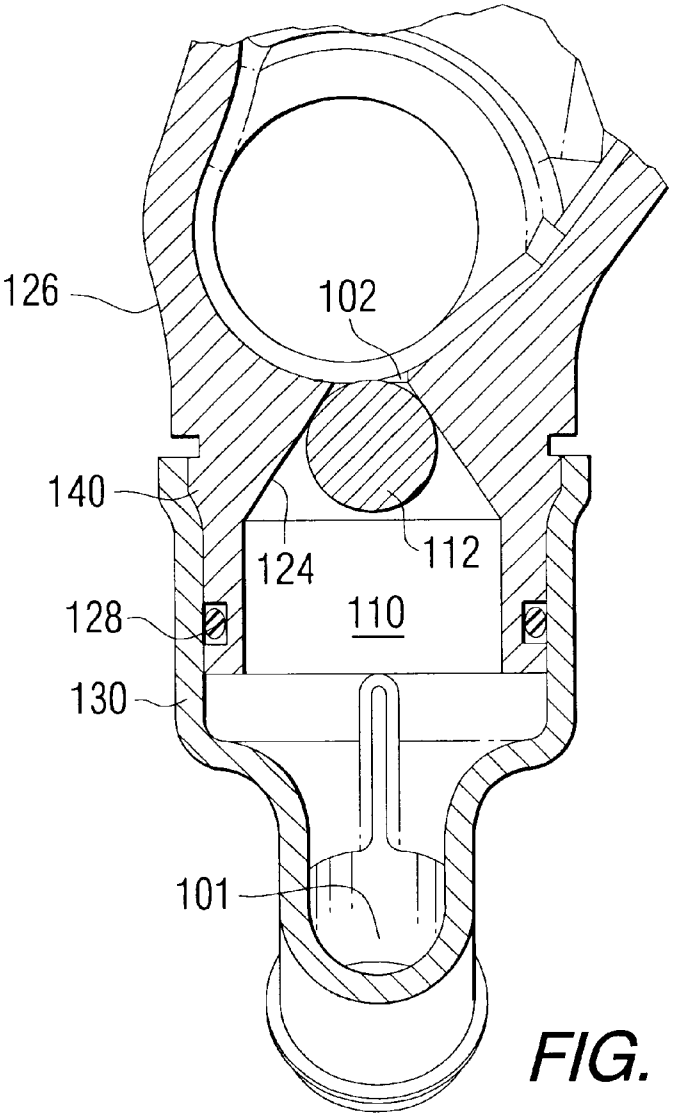
FIGS. 7 and 8 show two conditions of one embodiment of the present invention.
Figure 7:
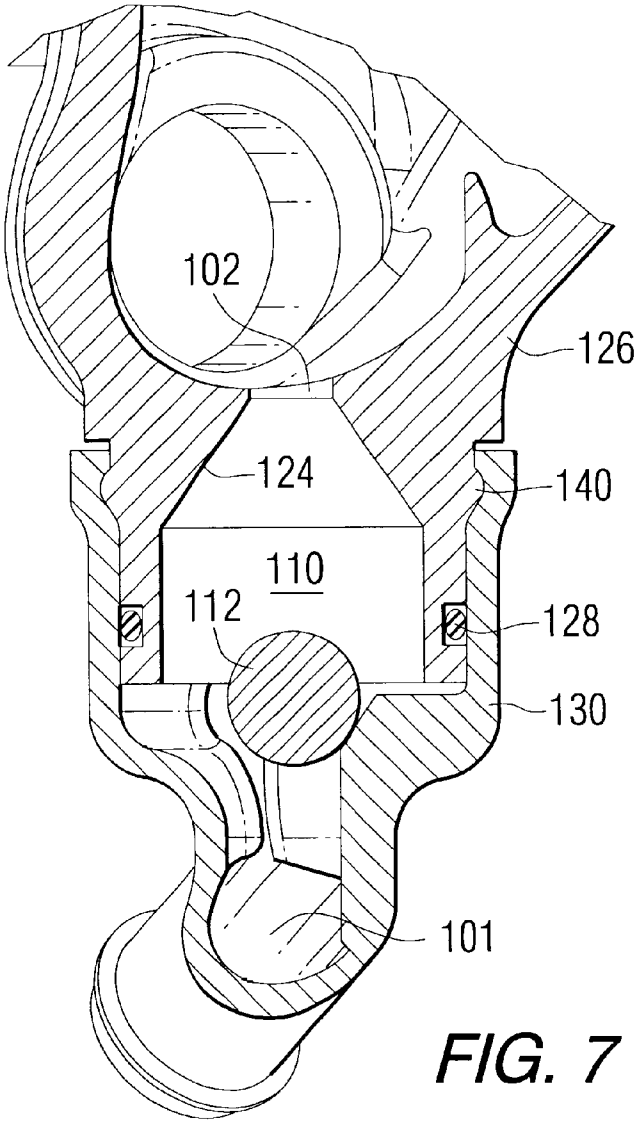

FIGS. 7 and 8 are section views of the member 126 of the water manifold 120 in combination with a valve section 130. The valve section 130 can be snapped onto the lower member 126 to define the cavity 110. The valve section 120 is pushed into position and a protruding ridge 140 attaches the valve section 120 to the lower member 126 of the water manifold 120. The ball 112 is captured within the cavity 120 defined by this assembly.

With particular reference to FIG. 8, the upward flow of water through the first port 101 toward the second port 102 causes the ball 112 to move upward against the ball seat 126 and prevent this upward flow. Alternatively, when pressure is not provided at the first port 101, the ball 112 is free to drop within the cavity 110, away from the ball seat 124, and allow water to freely drain downward through the valve from the second port 102 to the first port 101.

Figure 10:
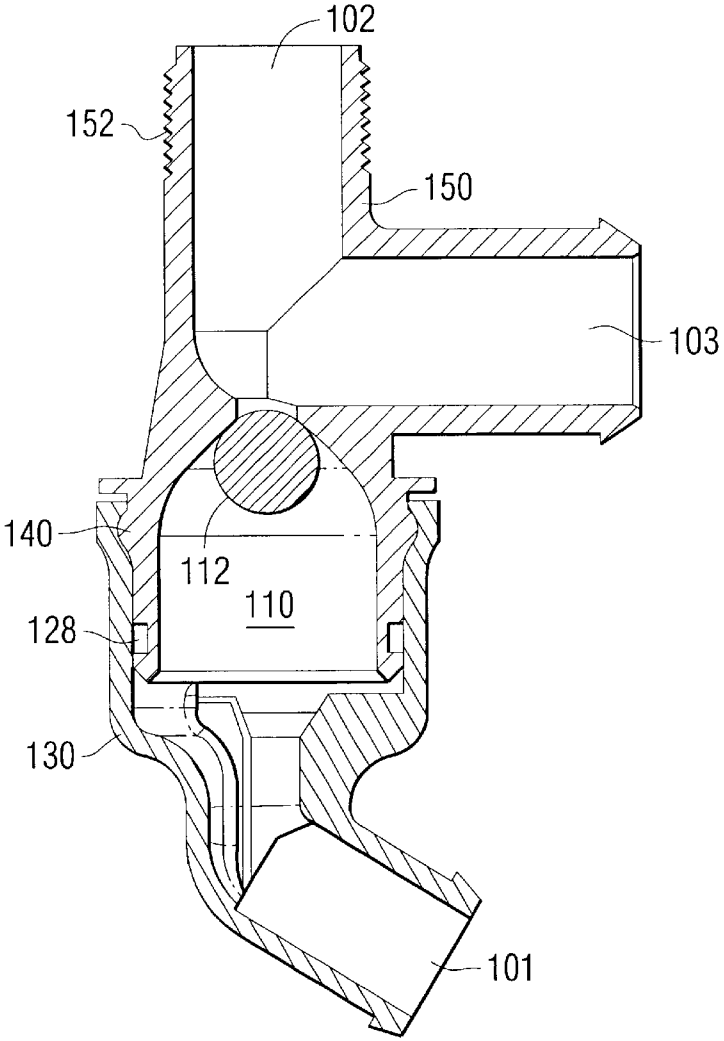
FIGS. 9 and 10 show two conditions of an alternative embodiment of the present invention.
Figure 9:
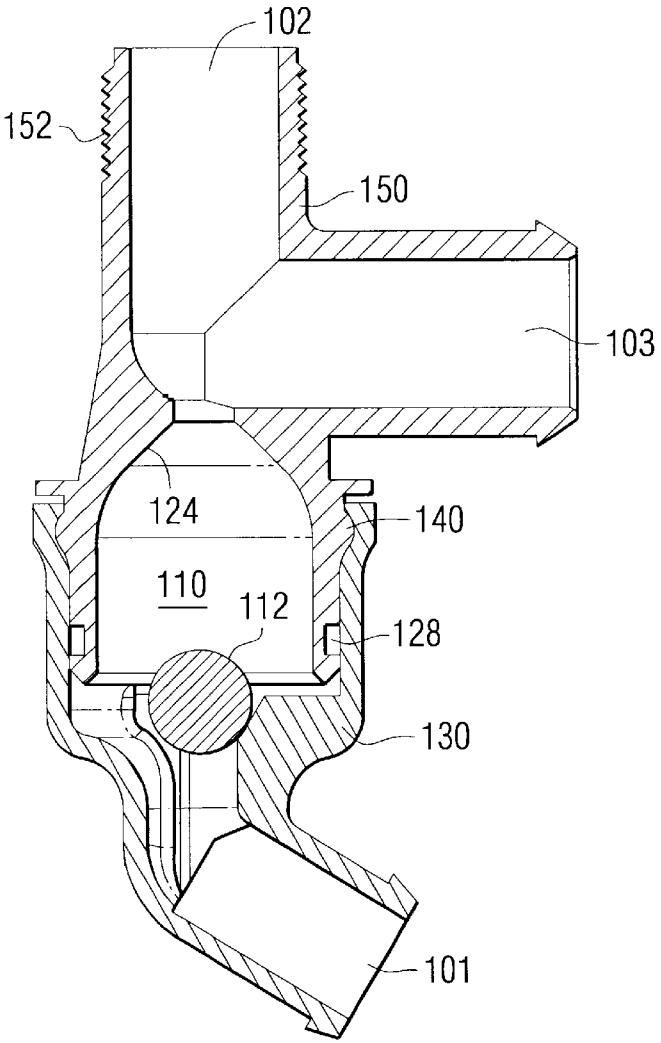

FIGS. 9 and 10 show a slightly different embodiment of the present invention which is intended for use with cooling systems that do not incorporate a water manifold 120 similar to that described above in conjunction with FIG. 5 which has a lower member 126 described above in conjunction with FIGS. 6–8. The embodiment shown in FIGS. 9 and 10 incorporates a T-shaped insert 150 that is threadable into the lower portion of an exhaust manifold. As can be seen, the second port 102 is provided with threads 152 for this purpose. The valve portion 130 can be snapped into position, with the assistance of the O-ring groove 128 and the circumferential protrusion 140. This assembly forms the cavity 110 which captures the ball 112 within it. When water is not being pumped by the water pump 10, to pressurize the fluid at the first port 101, the ball 112 is free to drop within cavity 110 and move away from the ball seat 124. This allows an open conduit for water to drain from the second port 102 downward through the cavity 110, around the ball 112, and out of the first port 101. When the pump 10 is energized and the fluid pressure of the first port 101 rises to a magnitude greater than the fluid pressure at the second and third ports, 102 and 103, as illustrated in FIG. 10, the ball 112 is moved upward through the cavity to block flow through the cavity 110 in an upward direction from the first port 101.

The present invention provides a way to easily drain the water from a marine engine. It does not require manual intervention to change the direction of flow through the valve 20. Instead, the ball 112 moves under the effects of gravity and fluid flow to assume the appropriate positions within the cavity 110. When the engine is running and the sea pump 10 is operating, the pressure at the first port 101 causes the ball to move upward against the ball seat 124 to block flow through the cavity 110. As a result, water is forced through the heat exchanger 22, which can be the engine heat exchanger, a power steering fluid heat exchanger, or any cooling passage formed in the engine 30. This results in a lower pressure at the third port 103 and the ball 112 can remain in its position against the ball seat 124. The water flows into the valve 20 through the third port 103 and out through the second port 102 to the exhaust manifold or other heat producing component. This occurs automatically because the ball 112 is moved into a blocking position against the ball seat 124 through the natural effects of water flow through the cavity 110 and pressure at the first port 101. No operator intervention is required for this to occur. When the seat pump 10 is not operating, and the pressure at the first port 101 decreases, the ball 112 is free to fall within the cavity 110 to unblock the passage from the second port 102 to the first port 101. This allows water to freely drain downward through the cavity 110 in the valve 20.

It should be understood that the present invention will operate as intended whether or not the ball 112 is less dense or more dense than water. Within reasonable limits of density, the combined effects of gravity on the ball 112 and the forces provided by fluid flow through the cavity 110 will place the ball 112 at the intended positions within the cavity 110 to allow both normal operation of the engine and the draining of the engine when the pump 10 is not operating.

Although the present invention has been described with particular specificity and illustrated to show several preferred embodiments, it should be understood that alternative embodiments are also within its scope.

We claim:

1. A marine engine cooling system, comprising:

a valve having first, second, and third ports, said valve having a cavity in fluid communication with said first, second, and third ports;

a ball disposed within said cavity, the position of said ball within said cavity being a function of forces of gravity and the movement of fluid through said cavity;

a pump having an outlet connected in fluid communication with said first port;

a fluid conducting component connected in fluid communication between said pump and said third port, said ball being movable upward within said cavity to at least partially block fluid flow from said first to said second ports when fluid pressure at said first port is higher than fluid pressure at said second port, fluid communication between said second and third ports remaining unaffected by movement of said ball within said cavity, a fluid path from said second port to said first port remaining open when fluid pressure at said first port is not greater than fluid pressure at said second port.

2. The cooling system of claim 1, further comprising:

an exhaust manifold having a water jacket disposed in fluid communication with said second port to receive cooling water from said second port.

3. The cooling system of claim 1, wherein:

said first port is disposed below said second port.

4. The cooling system of claim 1, wherein:

said fluid conducting component is a coolant passage of said marine engine.

5. The cooling system of claim 2, wherein:

said valve is attached for support to said exhaust manifold.

6. The cooling system of claim 1, wherein:

said marine engine cooling system is a closed system wherein water pumped from a body of water by said pump flows in thermal communication with a coolant which passes through cooling passages of said marine engine.

7. The cooling system of claim 1, wherein:

said marine engine cooling system is an open system wherein water pumped from a body of water by said pump flows through cooling passages of said marine engine in thermal communication with said engine.

8. The cooling system of claim 1, further comprising:

a power steering fluid cooler connected in fluid communication with said pump.

9. The cooling system of claim 1, wherein:

said third port is connected in fluid communication with a conduit between said cavity and said second port.

10. A marine engine cooling system, comprising:

a valve having first, second, and third ports, said valve having a cavity in fluid communication with said first, second, and third ports, said third port being connected in fluid communication with a conduit between said cavity and said second port;

a ball disposed within said cavity, the position of said ball within said cavity being a function of forces of gravity and the movement of fluid through said cavity;

a pump having an outlet connected in fluid communication with said first port;

a fluid conducting component connected in fluid communication between said pump and said third port, said ball being movable upward within said cavity to at least partially block fluid flow from said first to said second ports when fluid pressure at said first port is higher than fluid pressure at said second port, fluid communication between said second and third ports remaining unaffected by movement of said ball within said cavity, a fluid path from said second port to said first port remaining open when fluid pressure at said first port is not greater than fluid pressure at said second port.

11. The cooling system of claim 10, wherein:

upward movement of said ball within said cavity, away from said first port, blocks said second port and prevents flow through said cavity from said first port to said second port.

12. The cooling system of claim 11, further comprising:

an exhaust manifold having a water jacket disposed in fluid communication with said second port to receive cooling water from said second port.

13. The cooling system of claim 12, wherein:

said fluid conducting component is a heat exchanger.

14. The cooling system of claim 13, wherein:

said fluid conducting component is a coolant passage of said marine engine.

15. The cooling system of claim 12, wherein:

said valve is attached for support to said exhaust manifold.

16. The cooling system of claim 10, wherein:

said marine engine cooling system is a closed system wherein water pumped from a body of water by said pump flows in thermal communication with a coolant which passes through cooling passages of said marine engine.

17. The cooling system of claim 10, wherein:

said marine engine cooling system is an open system wherein water pumped from a body of water by said pump flows through cooling passages of said marine engine in thermal communication with said engine.

18. The cooling system of claim 10, further comprising:

a power steering fluid cooler connected in fluid communication with said pump.

19. A marine engine cooling system, comprising:

a valve having first, second, and third ports, said valve having a cavity in fluid communication with said first, second, and third ports, said first port being disposed below said second port, said third port being connected in fluid communication with a conduit between said cavity and said second port;

a ball disposed within said cavity, the position of said ball within said cavity being a function of forces of gravity and the movement of fluid through said cavity, wherein upward movement of said ball within said cavity, away from said first port, blocks said second port and prevents flow through said cavity from said first port to said second port;

a pump having an outlet connected in fluid communication with said first port;

a fluid conducting component connected in fluid communication between said pump and said third port, said fluid conducting component being a heat exchanger, said ball being movable upward within said cavity to at least partially block fluid flow from said first to said second ports when fluid pressure at said first port is higher than fluid pressure at said second port, fluid communication between said second and third ports remaining unaffected by movement of said ball within said cavity, a fluid path from said second port to said first port remaining open when fluid pressure at said first port is not greater than fluid pressure at said second port; and an exhaust manifold having a waterjacket disposed in fluid communication with said second port to receive cooling water from said second port, said valve being attached for support to said exhaust manifold.

20. The cooling system of claim 19, wherein:

said marine engine cooling system is a closed system wherein water pumped from a body of water by said pump flows in thermal communication with a coolant which passes through cooling passages of said marine engine.

* * * * *